US011261596B2

(12) United States Patent
Seo et al.

(10) Patent No.: US 11,261,596 B2
(45) Date of Patent: Mar. 1, 2022

(54) PRECAST WALL HAVING INCREASED POURING RESISTANCE

(71) Applicants: Taeyeong PCM Co., Ltd., Hwaseong-si (KR); Samsung Engineering Co., Ltd., Seoul (KR)

(72) Inventors: Hyung-Seck Seo, Hwaseong-si (KR); Yoon-Seop Shin, Seoul (KR)

(73) Assignees: Taeyeong PCM Co., Ltd., Hwaseong-si (KR); Samsung Engineering Co., Ltd., Seoul (KR)

( * ) Notice: Subject to any disclaimer, the term of this patent is extended or adjusted under 35 U.S.C. 154(b) by 0 days.

(21) Appl. No.: 16/823,713

(22) Filed: Mar. 19, 2020

(65) Prior Publication Data

US 2020/0299949 A1 Sep. 24, 2020

(30) Foreign Application Priority Data

Mar. 20, 2019 (KR) ..... 10-2019-0031910

(51) Int. Cl.

| | |
|---|---|
| ***E04B 1/04*** | (2006.01) |
| ***E04C 2/28*** | (2006.01) |
| *E02D 29/00* | (2006.01) |
| *E04C 2/00* | (2006.01) |

(52) U.S. Cl.

CPC ..... *E04B 1/043* (2013.01); *E04C 2/28* (2013.01); *E02D 29/04* (2013.01); *E04C 2002/002* (2013.01)

(58) Field of Classification Search

CPC ..... E02D 29/04; E02D 29/045; E04B 1/043; E04B 1/161; E04B 2/8617; E04B 2/8635; E04C 2/06; E04C 2/28; E04C 2002/002; E04C 2/045; E04G 17/06

See application file for complete search history.

(56) References Cited

U.S. PATENT DOCUMENTS 2,058,285 A * 10/1936 Amescua ..... E04B 2/68 52/262
3,221,457 A * 12/1965 Vevoda ..... E04B 2/8629 52/328
5,485,704 A * 1/1996 Sandor, Sr. ..... E04B 1/043 403/294

(Continued)

FOREIGN PATENT DOCUMENTS

DE 19520082 A1 * 12/1996 ..... E04B 2/8647
GB 2444637 A 6/2008

(Continued)

OTHER PUBLICATIONS

DE 19520082 A1 Machine Translation (Year: 2020).*

(Continued)

*Primary Examiner* — James M Ference

(74) *Attorney, Agent, or Firm* — Peter W. Schroen; Bret E. Field; Bozicevic, Field & Francis LLP

(57) ABSTRACT

The present disclosure relates generally to a precast wall having increased pouring resistance. The precast wall has a configuration by which resistance to the pouring pressure of concrete poured between outer and inner panels is increased, (Continued)

the configuration including rail members buried in outer and inner panels, link members disposed between connection members connecting the rail members in the outer and inner panels to act integrally, and coupling members.

8 Claims, 7 Drawing Sheets

(56) References Cited

U.S. PATENT DOCUMENTS

| | | | | |
|---|---|---|---|---|
| 6,401,417 | B1 | 6/2002 | Leblang | |
| 6,966,722 | B1 * | 11/2005 | Borror | F16B 5/025 403/3 |
| 2002/0059768 | A1 * | 5/2002 | Blount | B28B 23/06 52/600 |
| 2004/0020149 | A1 | 2/2004 | Messiqua | |
| 2011/0076110 | A1 * | 3/2011 | Burke | E04B 1/043 411/81 |
| 2012/0087742 | A1 * | 4/2012 | Ogorchock | E02D 29/02 405/262 |
| 2014/0308509 | A1 * | 10/2014 | Gaddes | E04B 1/161 428/223 |
| 2015/0191909 | A1 * | 7/2015 | Linares, III | E04C 2/46 52/309.11 |
| 2015/0322664 | A1 * | 11/2015 | Manning | E04C 5/073 52/742.15 |
| 2019/0169844 | A1 * | 6/2019 | Yousefi Darestani | E04C 2/06 |
| 2020/0299949 | A1 * | 9/2020 | Seo | E04C 2/06 |

FOREIGN PATENT DOCUMENTS

| | | | |
|---|---|---|---|
| KR | 10-1001208 | B1 | 12/2010 |
| KR | 101630235 | B1 | 6/2016 |
| KR | 101870087 | B1 | 7/2018 |
| WO | WO2016129826 | A1 | 8/2016 |

OTHER PUBLICATIONS

KR 101630235 Machine Translation (Year: 2021).*
KR 101870087 Machine Translation (Year: 2021).*
Notification of Reason for Refusal for Korean Application No. 10-2019-0031910 dated May 29, 2020, with its English translation, 15 pages.
Extended European Search Report for European Application No. 20164346.7 dated Aug. 24, 2020, 7 pages.
First Examination Report for Indian Application No. 201914027524 dated Oct. 19, 2020, 7 pages.
Grant of Patent for Korean Application No. 10-2019-0031910 dated Feb. 26, 2021, with its English translation, 2 pages.
Written Opinion for Singaporean Application No. 10201902883P dated Mar. 8, 2021, 4 pages.

* cited by examiner

[Fig. 1]
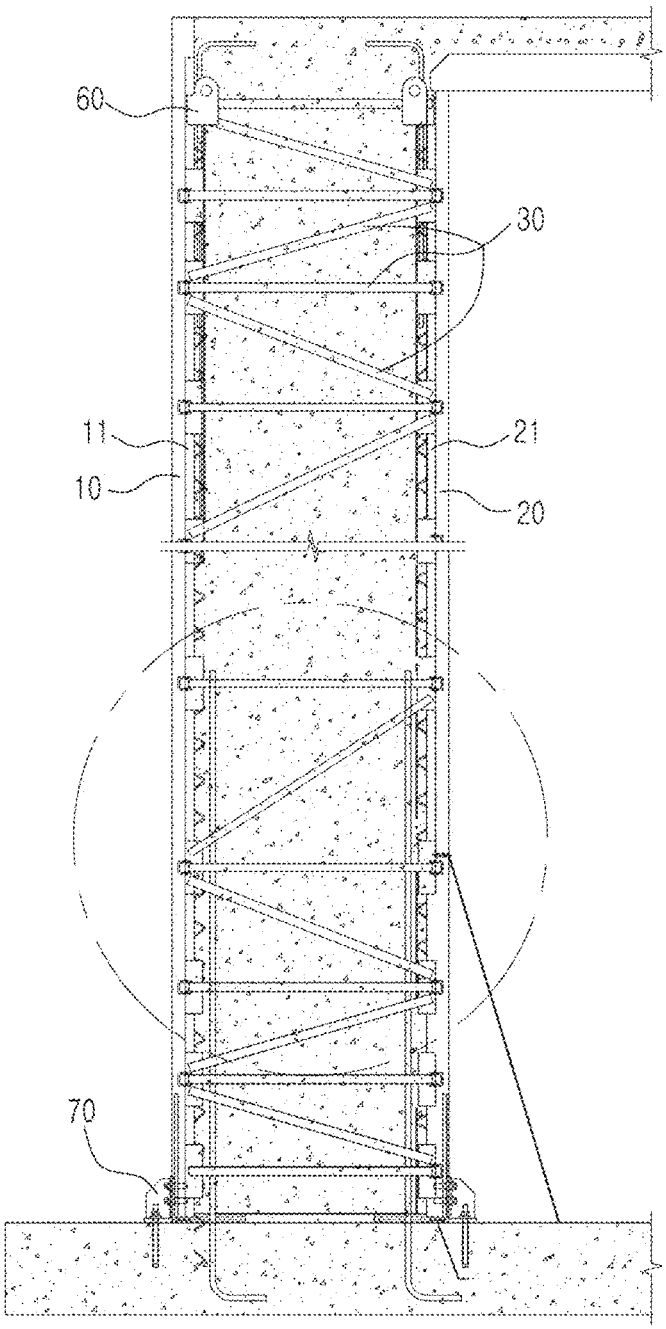

[Fig. 2]
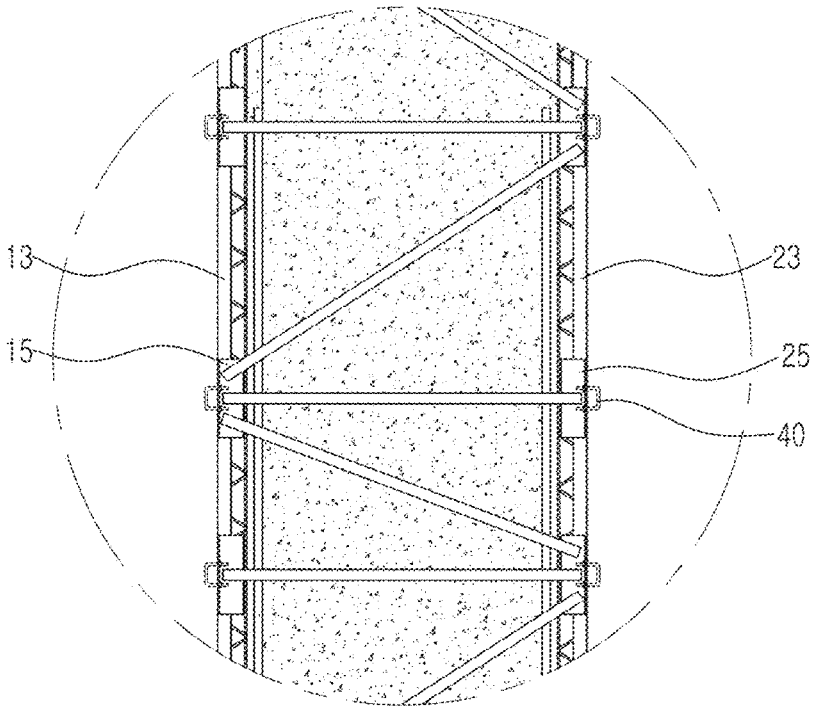
[Fig. 3]
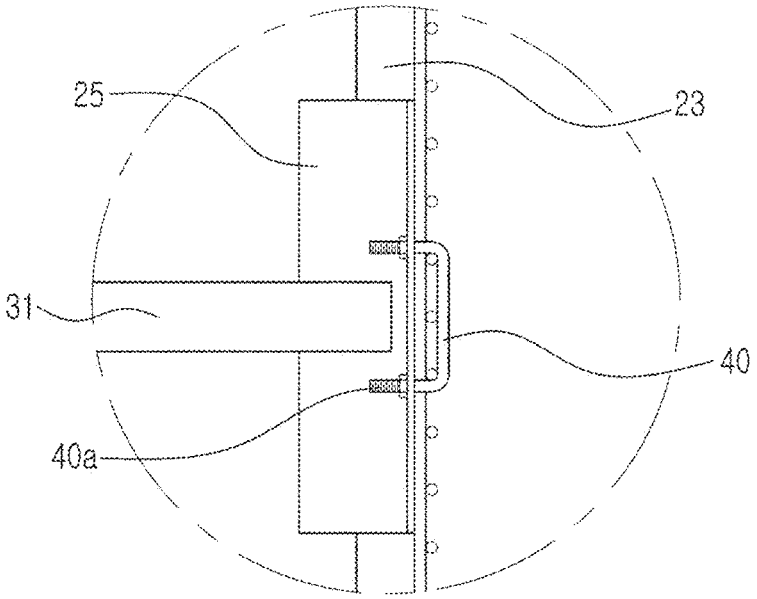

[Fig. 4]
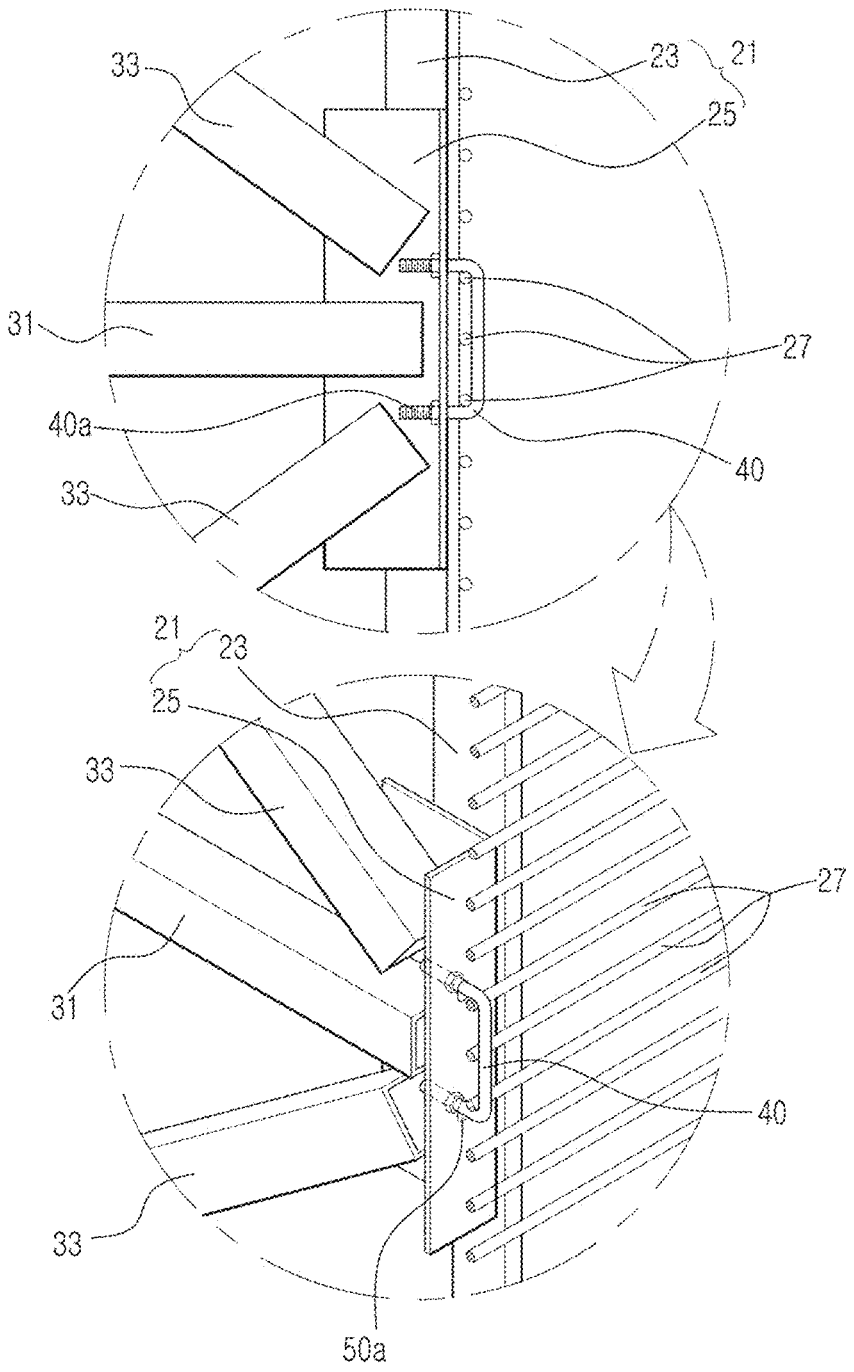

[Fig.5]
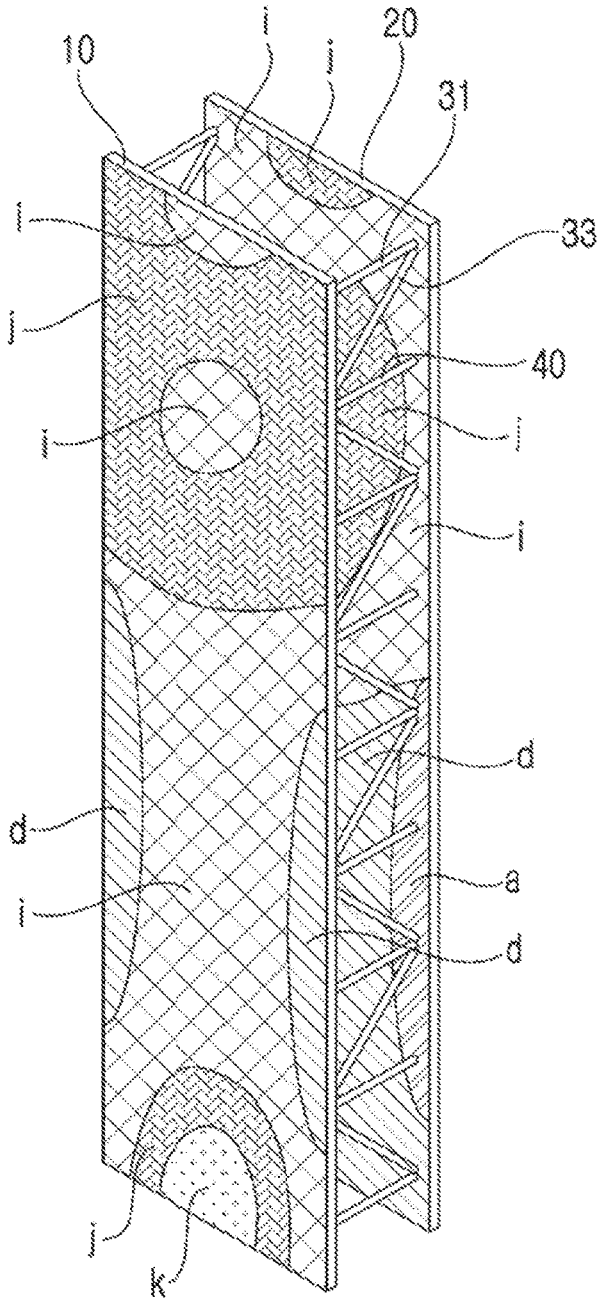
POST-PROCESSOR
DISPLACEMENT
RESULTANT
| | |
|---|---|
| | 5.86225e-004 |
| a | 5.32932e-004 |
| b | 4.79638e-004 |
| c | 4.26345e-004 |
| d | 3.73052e-004 |
| e | 3.19759e-004 |
| f | 2.66466e-004 |
| g | 2.13173e-004 |
| h | 1.59879e-004 |
| i | 1.06586e-004 |
| j | 5.32932e-005 |
| k | 0.00000e+000 |
SCALEFACTOR= 2.9426E+002
CB: SER
MAX : 11982
MIN : 8289
FILE: Pouring Pressure,
Verification
UNIT: m
DATE: 12/26/2017
VIEW-DIRECTION

[Fig.6]
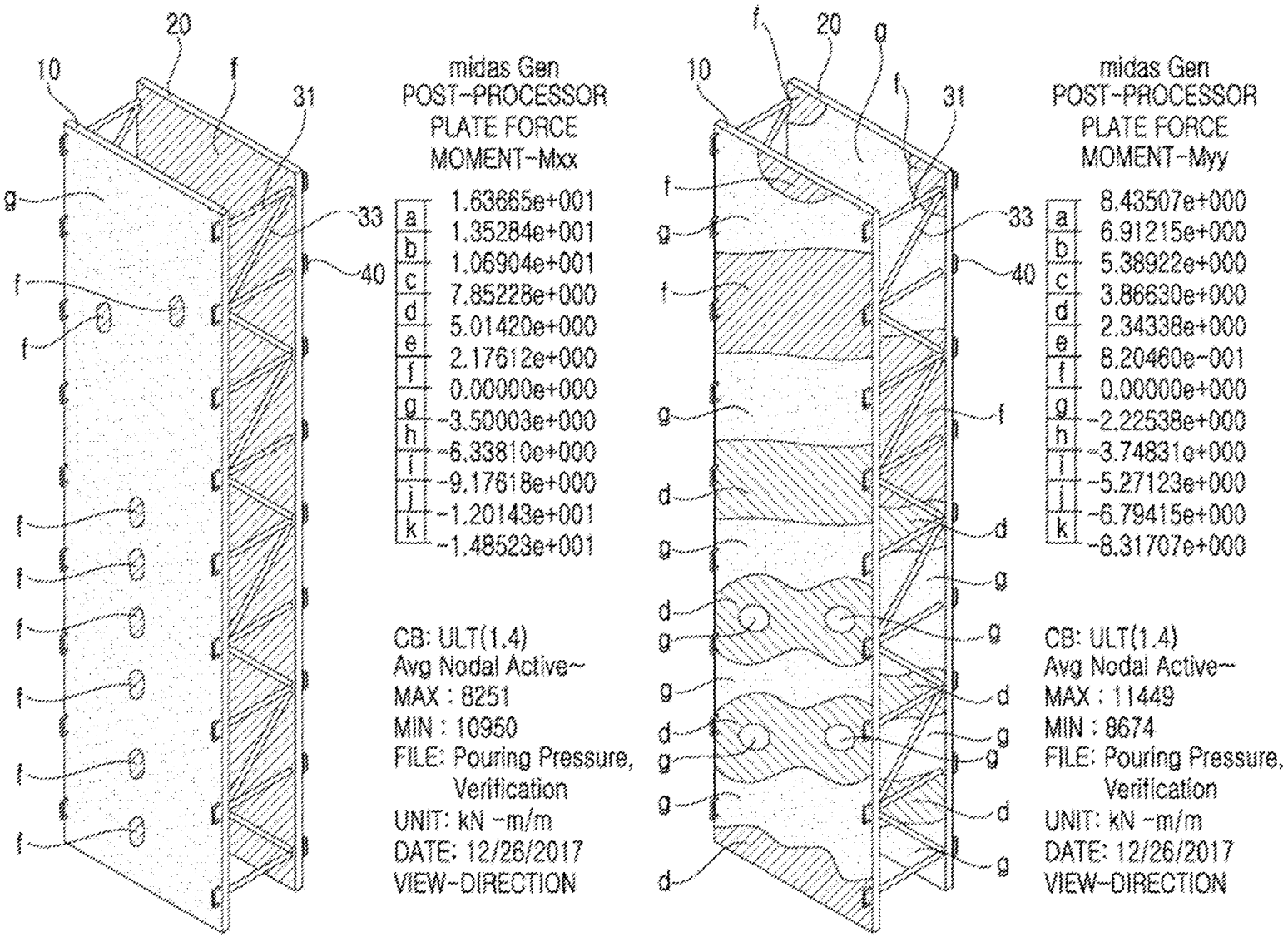

[Fig.7]
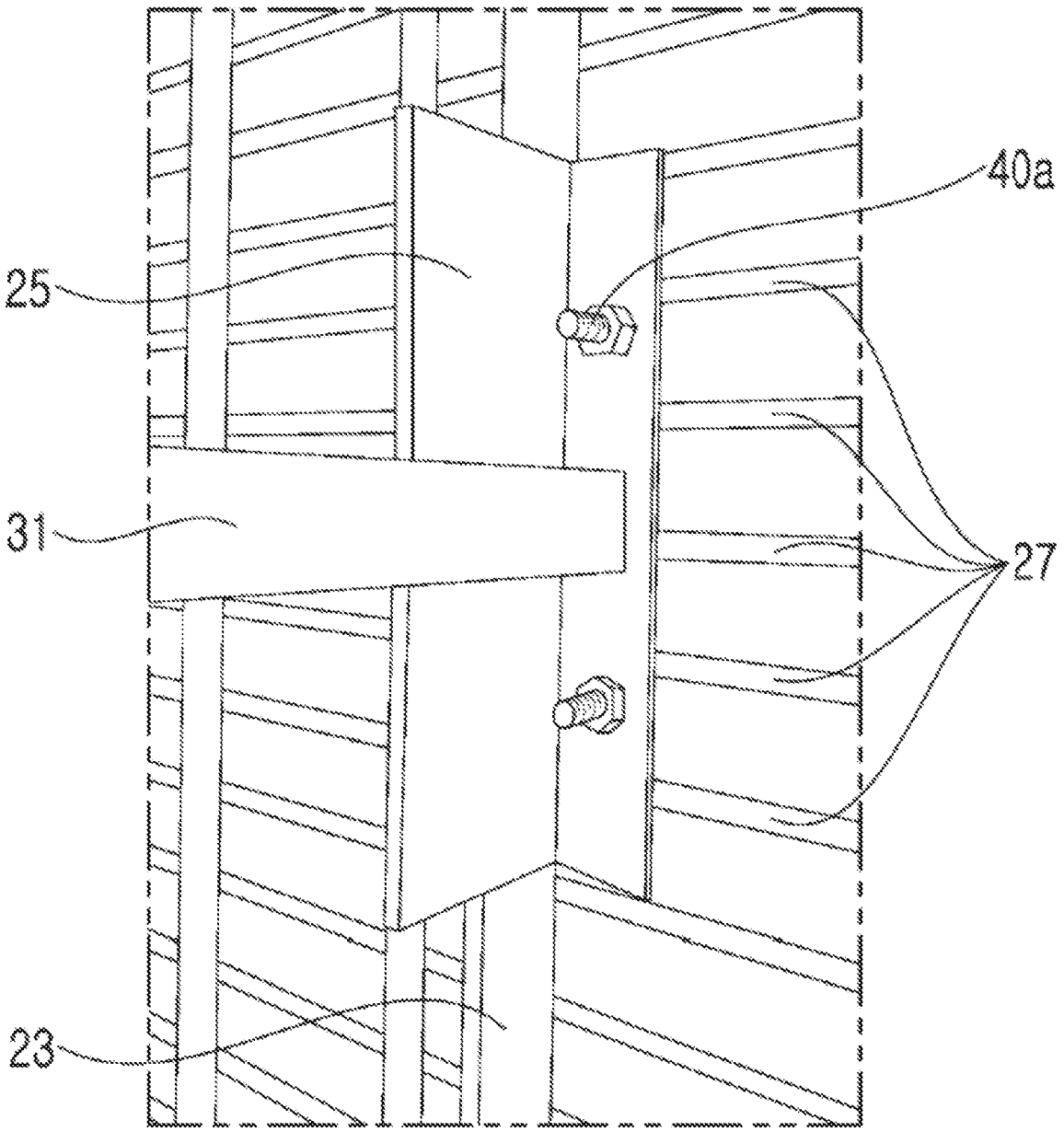

[Fig.8]
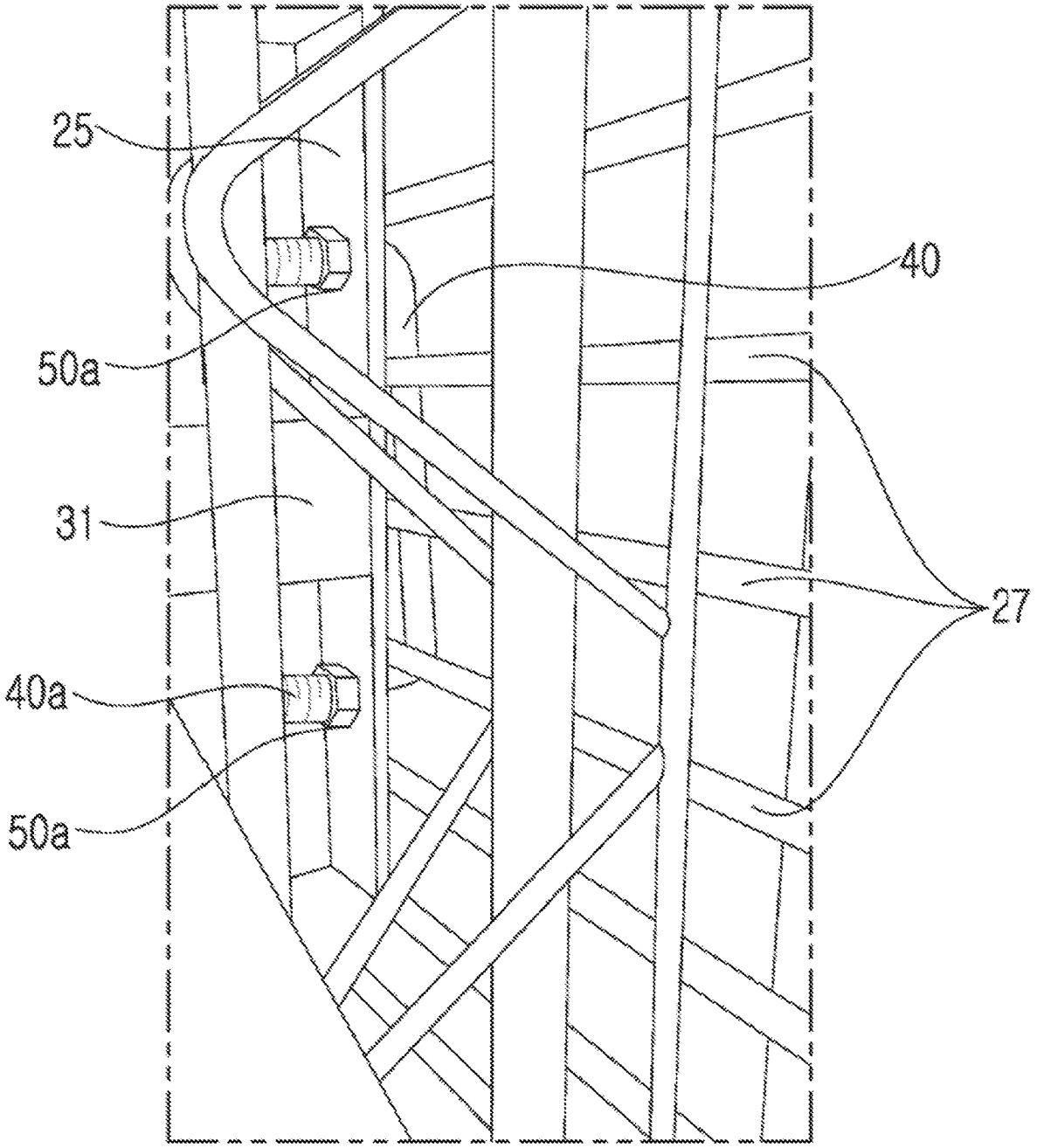

PRECAST WALL HAVING INCREASED POURING RESISTANCE

CROSS REFERENCE TO RELATED APPLICATION

The present application claims priority to Korean Patent Application No. 10-2019-0031910, filed Mar. 20, 2019 the entire contents of which is incorporated herein for all purposes by this reference.

BACKGROUND OF THE INVENTION

Field of the Invention

The present disclosure relates generally to a precast wall having increased pouring resistance and, more particularly, to a precast wall having increased resistance to pouring pressure during pouring of concrete between precast panels.

Description of the Related Art

The information disclosed in the Background of the Invention section is only for the enhancement of understanding of the background of the invention, and should not be taken as an acknowledgment or as any form of suggestion that this information forms a prior art that would already be known to a person skilled in the art, unless explicitly described to the contrary.

In general, a variety of underground structures having large capacity and a large space, such as a waste water disposal plant, an underground parking lot, and a rainwater storage, are buried in an underground foundation. Such underground structures are typically constructed by excavating a place, forming a foundation in the excavated place, forming outer walls from in-situ concrete (or cast-in-place concrete) on the foundation using a mold by a reinforced concrete (RC) method, and then seating precast concrete (PC) slabs or in-situ concrete slabs on upper ends of the outer walls.

However, the case of constructing a wall structure by the RC method has the problem of delayed construction period, since subsequent processing cannot be undertaken unless a mold is constructed and in-situ concrete is poured into the mold to form a wall. In addition, as a nuisance, molds must be constructed and then removed one by one. Furthermore, molds may be fractured during pouring of concrete on site, thereby frequently causing accidents, which are problematic.

To overcome the problems occurring when constructing a wall structure by the RC method of the related art, a method of constructing a wall structure using sandwich PC-walls was disclosed in Korean Patent No. 10-1001208, as illustrated in FIG. 1.

According to this related-art construction method, outer wall erecting recesses are formed in the upper surface of a foundation, a plurality of panels are fitted into the recesses to be erected while facing each other at distances, and in-situ concrete is poured into a space between the panels facing each other, so that a PC wall is constructed integrally with the panels.

In this related-art construction method, a plurality of panels is separately manufactured in a factory before being transported to a site. When the panels are erected at the site, in-situ concrete is poured into a central space. The separately-erected panels are spread outwards by pouring pressure of concrete. In order to prevent this, through-holes must be formed and form ties must be installed and connected. However, the form ties may be fractured during pouring of in-situ concrete, which is problematic. In addition, the through-holes formed in the inner panels may be subjected to a water leakage. In particular, since a significant amount of pressure is applied during pouring of concrete, even in the case in which an integrated panel structure is manufactured by connecting a plurality of panels using connection members and is erected before pouring of concrete, not only the shape of the connection members but also the shape of the panels may be deformed, due to lateral pressure applied to both sides of the panel structure. This may consequently degrade the reliability of a building or cause casualties or property loss. Accordingly, a structure for preventing panels from being deformed and increasing resistance by reducing as much lateral pressure applied during pouring of concrete as possible is required.

RELATED ART DOCUMENT (Patent Document 1) Korean Patent No. 10-1001208

SUMMARY OF THE INVENTION

Accordingly, the present disclosure has been made keeping in mind the above problems occurring in the related art, and the present disclosure proposes a precast wall having a structure by which resistance to the pouring pressure of concrete poured between outer and inner panels of the precast wall is increased.

The object of the present disclosure is not limited to the aforementioned description, and other objects not explicitly disclosed herein will be clearly understood by those skilled in the art to which the present disclosure pertains from the description provided hereinafter.

In order to achieve the above object, according to one aspect of the present disclosure, provided is a precast wall having an integrated wall structure constructed by pouring concrete between precast panels. The precast wall includes: an outer panel and an inner panel spaced apart at a distance and facing each other; a plurality of truss connection members connecting the outer panel and the inner panel; and rail members buried in the outer panel and the inner panel, respectively, and connected to the truss connection members. The connection members include horizontal members spaced apart at a distance and horizontally connecting the rail members and inclined members respectively connecting the rail members in an oblique direction between one horizontal member and another horizontal member of the horizontal members. The precast wall further includes coupling members respectively coupled one surface of a corresponding rail member, of the rail members connected to the truss connection members, in a longitudinal direction.

According to an exemplary embodiment, the rail members include extension members extending in longitudinal directions and buried in the outer panel and the inner panel and a plurality of link members connected to the extension members.

According to an exemplary embodiment, the coupling members may have a structure, with both end portions being bent in the same direction, and threads being formed on the both end portions.

According to an exemplary embodiment, the link members may have a bent shape, such that each of the connection members is joined to one surface of a corresponding link member among the link members, and each of the coupling members is coupled to the corresponding link member associated with a corresponding horizontal member of the horizontal members.

According to an exemplary embodiment, each of the coupling members may penetrate through the corresponding link member from a position opposite the truss connection members and is coupled to one surface of the corresponding link member by bolt-nut fastening.

According to an exemplary embodiment, the outer panel may be formed higher than the inner panel to provide an outer wall of the wall structure.

According to an exemplary embodiment, the precast wall may further include lifting plates disposed on upper free ends of the outer panel and the inner panel, such that lifting cables are connected to the lifting plates. A lifting plate of the lifting plates, protruding upward from the inner panel, may form a stepped portion between one portion of the lifting plate and an upper end of the inner panel.

According to an exemplary embodiment, the precast slab may be placed on the upper free ends of the outer panel and the inner panel, and in-situ concrete may be poured simultaneously into a central space between the outer panel and the inner panel and onto the precast slab.

According to an exemplary embodiment, the precast wall may be further include lower connection members fastening the lower ends of the outer panel and the inner panel to a foundation, thereby allowing the outer panel and the inner panel to resist wind load or impact load.

According to embodiments of the present disclosure, the precast wall has a configuration by which resistance to the pouring pressure of concrete poured between outer and inner panels is increased. The configuration includes rail members buried in outer and inner panels, link members disposed between connection members connecting the rail members in the outer and inner panels to act integrally, and coupling members. Accordingly, it is possible to minimize lateral deformation in the inner and lower panels.

In addition, according to embodiments of the present disclosure, the precast wall structure can reduce accidents or property loss, due to deformations in buildings, thereby improving reliability or safety.

The effects of the present disclosure are not limited to the aforementioned description, and other effects not explicitly disclosed herein will be clearly understood by those skilled in the art from the description of the appended Claims.

BRIEF DESCRIPTION OF THE DRAWINGS

The above and other objects, features and advantages of the present disclosure will be more clearly understood from the following detailed description when taken in conjunction with the accompanying drawings, in which:

FIG. 1 is a schematic view illustrating a configuration of a precast wall according to an embodiment of the present disclosure;

FIG. 2 is a detailed view of the truss connection member of the precast wall according to an embodiment of the present disclosure;

FIG. 3 is a detailed view of the coupling member fastened to the link member in the precast wall according to an embodiment of the present disclosure, before the inner panel is constructed;

FIG. 4 is a detailed view of the truss connection member and the coupling member coupled to the link member in the precast wall according to an embodiment of the present disclosure, before the inner panel is constructed;

FIG. 5 illustrates degrees of bending due to lateral pressure during pouring of concrete in a precast wall according to an embodiment of the present disclosure; and FIG. 6 illustrates degrees of bending due to lateral pressure during pouring of concrete in a precast wall according to an embodiment of the present disclosure, in a case in which coupling members are coupled to link members;

FIG. 7 is a picture image of FIG. 4; and

FIG. 8 is another picture image of FIG. 4.

DETAILED DESCRIPTION OF THE INVENTION

Hereinafter, a configuration, operation, and effects of precast wall according to exemplary embodiments of the present disclosure will be described with reference to the accompanying drawings. For reference, in the drawings, components are omitted or schematically illustrated for the sake of convenience and clarity, and the size of each component may not reflect the actual size. Throughout this document, the same reference numerals and symbols will be used to designate the same or like components. In individual drawings, reference numerals of the same components will be omitted.

FIG. 1 is a schematic view illustrating a configuration of a precast wall according to an embodiment of the present disclosure, and FIG. 2 is a detailed view of the truss connection member of the precast wall according to an embodiment of the present disclosure.

According to the embodiment of disclosure, the precast wall has an integrated wall structure constructed by pouring concrete between precast panels. The precast wall includes: an outer panel 10 and an inner panel 20 spaced apart at a specific distance and facing each other; a plurality of truss connection members 30 connecting the outer panel 10 and the inner panel 20; and rail members 11 and 21 (at least partially) buried in the outer panel 10 and the inner panel 20, respectively, and connected to the truss connection members 30. The truss connection members 30 include horizontal members 31 spaced apart at a specific distance and horizontally connecting the rail members 11 and 21 and inclined members 33 respectively connecting the rail members 11 and 21 in an oblique (inclined) direction between one horizontal member 31 and another horizontal member 31. The precast wall further includes coupling members 40 respectively coupled one surface of a corresponding rail member, of the rail members 11 and 21 connected to the truss connection members 30, in a longitudinal direction.

First, in a position in which the precast outer and inner panels are spaced apart at distances and face each other such that concrete can be poured into a space therebetween, a wall is formed by pouring concrete into the space between the outer and inner panels. In this manner, outer walls of a building can be constructed. Here, the precast panels are comprised of the outer panel 10 and the inner panel 20 spaced apart at a specific distance. According to an exemplary characteristic of the present disclosure, the outer panel 10 may be higher than the inner panel 20 in order to provide an outer wall of the wall structure. This is because, in the precast wall forming the outer wall of a structure such as a building, the outer panel 10 is required to be higher than the inner panel 20. However, in the case of an inner wall of the structure, the outer panel 10 and the inner panel 20 may be formed to have the same height.

After the outer panel 10 and the inner panel 20 are disposed to face each other, truss girders are additionally disposed on the inner surfaces of the outer panel 10 and the inner panel 20 to reinforce the front ends of the wall, thereby further reinforcing the integration of the outer and inner panels and the connection members.

When the outer panel 10 and the inner panel 20 are disposed to face each other, the truss connection members 30 are disposed between the outer panel 10 and the inner panel 20 to connect the outer panel 10 and the inner panel 20. The rail members 11 and 21 are further provided to be buried in the outer panel 10 and the inner panel 20, thereby allowing the truss connection members 30 to be connected to the outer panel 10 and the inner panel 20. The rail members 11 and 21 include the first rail member 11 buried in the outer panel 10 in the longitudinal direction and the second rail member 21 buried in the inner panel 20 in the longitudinal direction, in a position opposing the first rail member 11.

The truss connection members 30 include the horizontal members 31 horizontally connecting the rail members 11 and 21 and the inclined members 33 respectively connecting the rail members 11 and 21 in an oblique (inclined) direction between one horizontal member 31 and another horizontal member 31. More specifically, the horizontal members 31 of the truss connection members 30 may horizontally connect the first rail member 11, buried in the outer panel 10, and the second rail member 21, buried in the inner panel 20, to connect the outer panel 10 and the inner panel so that the outer and inner panels 10 and 20 act integrally. As illustrated in FIG. 1 or 2, the horizontal members 31 may arranged in a top-bottom direction. In addition, the inclined members 33 of the truss connection members 30 may be a plurality of inclined members arranged in inclined directions between the horizontal members 31 to effectively distribute load applied to the outer panel 10 and the inner panel 20. Here, the truss connection members according to the present disclosure may be steel pipes having a rectangular cross-section or may be L-shaped steel pipes. Although members having various shapes, such as steel pipes having a circular cross-section, H-beams, and steel bars, may be used, the present disclosure is not limited thereto. Other members may be used as long as the same purpose and function can be obtained.

Although the horizontal members 31 may generally be arranged at equal distances, the distances of the horizontal members 31 are not necessarily equal, since the horizontal members 31 are arranged by calculating the bearing force between the outer panel 10 and the inner panel 20.

Here, the horizontal members 31, disposed in the lower area of the space between the outer panel 10 and the inner panel 20, may be arranged at narrower top-bottom distances than the remaining areas. In addition, the horizontal members 31, disposed in the upper area of the space between the outer panel 10 and the inner panel 20, may also be arranged at narrower top-bottom distances than the remaining areas.

According to an exemplary characteristic of the present disclosure, lifting plates 60 are additionally disposed on the upper free ends of the outer panel 10 and the inner panel 20, such that lifting cables are connected to the lifting plates 60. The lifting plate 60 protrudes upward from the inner panel 20, such that a stepped portion is formed between one portion of the lifting plate 60 and the upper end of the inner panel 20.

On the upper free ends of the outer panel 10 and the inner panel 20, the lifting plates 60 may be joined to the trusses, e.g. by welding, such that the lifting cables are connected to the lifting plates 60. This allows the outer panel 10 and the inner panel 20 to be integrally bound and erected. That is, the lifting plates 60 are additionally disposed on the upper free ends of the outer panel 10 and the inner panel 20, such that the lifting cables can be connected to the outer panel 10 and the inner panel 20. In a case of construction of an outer wall of a wall structure of an underground structure, such as a waste water disposal plant, in which the outer panel 10 is higher than the inner panel 20, the lifting plate disposed on the upper free end of the inner panel 20 additionally functions as a stopper for a precast slab. In addition, in a case of construction of an inner wall of a wall structure of an underground structure, such as a waste water disposal plant, in which the outer panel 10 and the inner panel 20 have the same heights, the lifting plates 60 are additionally disposed on the upper free ends of the outer panel 10 and the inner panel 20, such that the lifting cables can be connected to the lifting plates 60. All of the lifting plates 60 additionally function as stoppers for precast slabs. In addition, anti-fracture earth pressure pads or L-shaped section steel may be provided on lower ends of the outer panel 10 and the inner panel 20 to protect edges or corners from fracture when the precast wall structure is erected.

In addition, according to an exemplary characteristic of the present disclosure, precast slabs are placed on the upper free ends of the outer panel 10 and the inner panel 20, and in-situ concrete is poured simultaneously into a central space between the outer panel 10 and the inner panel 20 and onto the precast slabs.

According to an exemplary characteristic of the present disclosure, the lower ends of the outer panel 10 and the inner panel 20 are fastened to a foundation via lower connection members 70, such that the outer panel 10 and the inner panel 20 can resist wind load or impact load.

The lower ends of the outer panel 10 and the inner panel 20 are fastened to the foundation. Here, the lower ends may be fastened to the foundation via the lower connection members 70, such that the outer panel 10 and the inner panel 20 can resist wind load or impact load. More particularly, the lower ends may be fastened to the foundation via bolts. However, the present disclosure is not limited thereto.

In addition, according to an exemplary characteristic of the present disclosure, the coupling members 40 are respectively connected to one surface of a corresponding rail member, of the rail members 11 and 21 connected to the truss connection members 30, in a longitudinal direction.

According to an exemplary characteristic of the present disclosure, each of the rail members 11 and 21 includes an extension member 13 or 23 extending in longitudinal directions and buried in the outer panel 10 and the inner panel 20 and a plurality of link members 15 or 25 connected to the extension members 13 and 23.

The link members 15 and 25 may be provided as plate-shaped members or may be provided as members having a bent shape, such as L-shaped section steel. The link members 15 and 25 are components inserted to maximize joining areas in a case in which the horizontal members 31 and the inclined members 33 are connected to the rail members 11 and 21. More specifically, when the rail members 11 and 21 are connected to the truss connection members 30, the link members 15 and 25 may be jointed to the rail members 11 and 21 by, for example, welding. One surface of each of the link members 15 and 25, implemented as L-shaped section steel, is joined to one surface of the corresponding connection member 30 by, for example, welding. Here, surfaces of the truss connection members 30 may be fixedly joined to corresponding surfaces of the link members 15 and 25 by, for example, welding.

According to an exemplary characteristic of the present disclosure, both end portions of each of the coupling members 40 are bent in the same direction, with threads being formed on the both end portions.

According to an exemplary characteristic of the present disclosure, the link members 15 and 25 have a bent shape. Each of the truss connection members 30 may be joined to one surface of a corresponding link member of the link members 15 and 25, while each of the coupling members 40 may be coupled to a corresponding link member of the link members 15 and 25.

In addition, according to an exemplary characteristic of the present disclosure, each of the coupling members 40 may be coupled to one surface of the corresponding link member 15 or 25 by penetrating through the corresponding link member 15 or 25 from a position opposite the truss connection members 30.

Here, the coupling members 40 may be implemented as C-shaped bolts or U-shaped bolts. As illustrated in FIGS. 3 and 4, through-holes 50*a* are formed in each of the link members 15 and 25, while threaded portions 40*a* having diameters equal to the diameters of the through-holes 50*a* are coupled to the through-holes 50*a* by penetrating through the same, such that nuts are fastened with the threaded portions 40*a*. The configuration in which the coupling members 40 are coupled to the link members 15 and 25 and the truss connection members 30 are fixed to the link members 15 and 25 by, for example, welding, as described above, can increase resistance against pouring pressure formed by concrete poured between the outer panel 10 and the inner panel 20, connected via the truss connection members 30. That is, the configuration of the coupling members 40 coupled to the rail members 11 and 21 can minimize displacements (deformations) of the rail members 11 and 21. More particularly, the link members 15 and 25 of the rail members 11 and 21, caused by the pouring pressure of concrete, can be minimized so that resistance to the pouring pressure can be increased.

FIGS. 7 and 8 are picture images of FIG. 4.

The precast wall according to an embodiment of the present disclosure further includes reinforcing members 17 and reinforcing members 27 connecting a plurality of extension members 13 and a plurality of extension members 23 buried in the outer panel 10 and the inner panel 20. Specifically, the outer panel 10 and the inner panel 20 are shaped as plates having predetermined thicknesses to provide a wall. The truss connection members 30 connect the outer panel 10 and the inner panel 20. The plurality of extension members 13 and the plurality of extension members 23 are disposed within the outer panel 10 and the inner panel 20, extending in longitudinal directions of the outer panel 10 and the inner panel 20. The reinforcing members 17 and 27 may be disposed within the panels, such that the reinforcing members 17 and 27 connect the plurality of extension members 13 and the plurality of extension members 23.

According to an exemplary characteristic of the present disclosure, each of the coupling members 40 may be coupled to one surface of the corresponding link member of the link member 15 or 25, to which corresponding reinforcing members among the plurality of reinforcing members 17 and 27 are joined, by bolt-nut fastening by penetrating through the corresponding link member 15 or 25 from a position opposite the truss connection members 30.

The members may be displaced (deformed) by the pouring pressure occurring during pouring of concrete applied thereto. That is, the members may be displaced, since the rail members and 21 fail to resist the pouring pressure, or the reinforcing members 17 and 27 are warped by the pouring pressure. Thus, as illustrated in FIGS. 4, 7, and 8, each of the coupling members 40 implemented as C-shaped bolts is coupled to one surface of the corresponding link member of the link members 15 and 25 by bolt-nut fastening by penetrating through the corresponding link member 15 or 25, with the reinforcing members 17 and 27 being fitted between the coupling members 40 and the link members 15 and 25. According to this configuration, the coupling members 40 can minimize the reinforcing members 17 and 27 from being deformed by the pouring pressure.

FIG. 5 illustrates degrees of bending due to lateral pressure during pouring of concrete in a precast wall according to an embodiment of the present disclosure.

In general, concrete is poured into a space between the outer panel 10 and the inner panel 20 at a rate (R) 1.0 m/hr, and has a temperature of about 10° C. Lateral pressure P applied to the outer and inner panels at this time is as follows:

Lateral pressure $P=7.2+(1160+240R)/(T+18)=57.2$ kN/m$^2$ (This corresponds to a wall, the pouring rate of which is equal to or slower than 2.1 m/hr, and the pouring height of which exceeds 4.2 m., as guided by the concrete standard specification)

Here, a load factor for pouring pressure F is 1.4.

When concrete is poured under the above-described conditions, a maximum lateral displacement (deformation) occurring in the members is 0.59 mm, as represented in FIG. 5. Here, pull-out strength due to lateral pressure is as follows.

Axial force of lateral truss connection member (horizontal member 31)=42 kN

Axial force of inclined truss connection member (inclined member 33)=23 kN (at an angle of inclination 36.8°)

Sum of pull-out strength=42+2*23*cos(36.8°)=79 kN

FIG. 6 illustrates degrees of bending due to lateral pressure during pouring of concrete in a precast wall according to an embodiment of the present disclosure, in a case in which the coupling members are coupled to the link members.

When concrete is poured in a position in which the C-shaped bolts are coupled to the link members 15 and 25, the pull-out strength of the truss connection members in portions in which the C-shaped bolts are buried is calculated as follows:

Tensile strength of steel: $\Phi As.Fu.n=0.75*(13^2\pi/4)*400*2/1000=80$ kN>Pull-out strength=79 kN Here, as illustrated in FIG. 6, when concrete is poured into a space between the outer and inner panels in a position in which the C-shaped bolts are used, the member force of the precast wall due to lateral pressure is as follows:

Maximum member force in lateral direction=16.4 kN*m/m

Maximum member force in longitudinal direction=8.4 kN*m/m

Comparing FIGS. 5 and 6, it can be appreciated that lateral force applied to the panels in the case in which the C-shaped bolts are used is different from lateral force applied to the panels in the case in which no C-shaped bolts are used. Accordingly, when the C-shaped bolts are used, a lateral displacement (deformation) of the members can be minimized.

Although the foregoing exemplary embodiments of the present disclosure have been described with reference to the accompanying drawings, the embodiments described in the specification and the configurations illustrated in the drawings are merely best modes of the present disclosure, rather than representing all aspects of the scope of the present disclosure. It should be understood that a variety of equivalents and alternative embodiments could be made at a point in time at which the present application was filed. Accordingly, the foregoing embodiments shall be interpreted as being illustrative, while not being limitative, in all aspects.

It should be understood that the scope of the present disclosure shall be defined by the appended Claims rather than by the foregoing embodiments, and that all of modifications and alterations derived from the definition of the Claims and their equivalents fall within the scope of the present disclosure.

DESCRIPTION OF THE REFERENCE NUMERALS IN THE DRAWINGS

10: outer panel
11: first rail member
13: extension member
15: link member
17: reinforcing member
20: inner panel
21: second rail member
23: extension member
25: link member
27: reinforcing member
30: connection member
31: horizontal member
33: inclined member
40: coupling member
40*a*: threaded portion
50*a*: through-hole
60: lifting plate
70: lower connection member

What is claimed is:

1. A precast wall having an integrated wall structure comprising concrete between precast panels, the precast wall comprising:

an outer panel and an inner panel spaced apart at a distance and facing each other;

a plurality of truss connection members connecting the outer panel and the inner panel; and rail members buried in the outer panel and the inner panel, respectively, and connected to the truss connection members, wherein the truss connection members include horizontal members spaced apart at a distance and horizontally connecting the rail members and inclined members respectively connecting the rail members in an oblique direction between one horizontal member and another horizontal member of the horizontal members; and coupling members respectively coupled to one surface of a corresponding rail member of the rail members connected to the truss connection members, in a longitudinal direction, wherein:

the rail members comprise extension members extending in longitudinal directions and buried in the outer panel and the inner panel and a plurality of link members connected to the extension members;

the coupling members comprise end portions being bent in a same direction and threads being formed on the end portions;

the precast wall further includes a plurality of reinforcing members connecting the extension members; and the coupling members are coupled to one surface of the link members with the reinforcing members being fitted between the coupling members and the link members.

2. The precast wall according to claim 1, wherein the link members have a bent shape, such that each of the truss connection members is joined to one surface of a corresponding link member among the link members, and each of the coupling members is coupled to the corresponding link member associated with a corresponding horizontal member of the horizontal members.

3. The precast wall according to claim 2, wherein each of the coupling members penetrates through the corresponding link member from a position opposite the truss connection members and is coupled to one surface of the corresponding link member by a bolt-nut fastening.

4. The precast wall according to claim 3, wherein the outer panel is positioned higher than the inner panel to provide an outer wall of the integrated wall structure.

5. The precast wall according to claim 3, further comprising lifting plates disposed on upper free ends of the outer panel and the inner panel, such that lifting cables are connected to the lifting plates, wherein a lifting plate of the lifting plates, protruding upward from the inner panel, forms a stepped portion between one portion of the lifting plate and an upper end of the inner panel.

6. The precast wall according to claim 3, wherein a precast slab is placed on the upper free ends of the outer panel and the inner panel, and in-situ concrete is poured simultaneously into a central space between the outer panel and the inner panel and onto the precast slab.

7. The precast wall according to claim 3, further comprising lower connection members fastening the lower ends of the outer panel and the inner panel to a foundation, thereby allowing the outer panel and the inner panel to resist wind load or impact load.

8. The precast wall according to claim 1, further comprising lower connection members fastening lower ends of the outer panel and the inner panel to a foundation, thereby allowing the outer panel and the inner panel to resist wind load or impact load.

* * * * *